US007258314B1

(12) United States Patent
Parduhn et al.

(10) Patent No.: US 7,258,314 B1
(45) Date of Patent: Aug. 21, 2007

(54) SPAN WIRE ASSEMBLY FOR TRAFFIC CONTROL DEVICE

(75) Inventors: Stephen P. Parduhn, Edmond, OK (US); Darold R. Cherry, Round Rock, TX (US); Robert D. Magness, Jr., Edmond, OK (US)

(73) Assignee: Pelco Products, Inc., Edmond, OK (US)

( * ) Notice: Subject to any disclaimer, the term of this patent is extended or adjusted under 35 U.S.C. 154(b) by 96 days.

(21) Appl. No.: 11/160,165

(22) Filed: Jun. 10, 2005

(51) Int. Cl.
*E04G 3/00* (2006.01)

(52) U.S. Cl. ..... 248/214; 362/431

(58) Field of Classification Search ..... 248/214, 248/317, 328; 362/431, 250, 370, 419; 340/931
See application file for complete search history.

(56) References Cited

U.S. PATENT DOCUMENTS 4,659,046 A 4/1987 Parduhn
5,105,350 A * 4/1992 Tolman et al. ..... 362/431
D328,243 S 7/1992 Parduhn
D335,279 S 5/1993 Parduhn
5,299,111 A 3/1994 Parduhn et al.
5,504,481 A * 4/1996 Wys ..... 340/931
D373,947 S 9/1996 Parduhn
D379,756 S 6/1997 Parduhn
5,645,255 A 7/1997 Parduhn
6,204,446 B1 3/2001 Parduhn
6,357,709 B1 3/2002 Parduhn

OTHER PUBLICATIONS

Pelco Products Inc., Assembly Sheet for Span Wire Assembly for Harris County Texas, dated Jan. 6, 2004 (Oklahoma City OK USA).

* cited by examiner

*Primary Examiner*—Ramon O Ramirez
(74) *Attorney, Agent, or Firm*—Mary M. Lee

(57) ABSTRACT

A span wire assembly for supporting a traffic control device. The span wire assembly includes a pair of vertical members or cast arms for attachment to the traffic control device. The cast arms are integrally formed with tubular ends and a centrally positioned wiring passage. A span wire assembly utilizing the inventive cast arms has fewer parts and, consequently, is simpler for the manufacturer to produce and for the customer to use.

9 Claims, 6 Drawing Sheets

SPAN WIRE ASSEMBLY FOR TRAFFIC CONTROL DEVICE

FIELD OF THE INVENTION

The present invention generally relates to traffic control devices and, more particularly but without limitation, to span wire assemblies for supporting traffic devices.

BACKGROUND OF THE INVENTION

Traffic signals and other traffic control devices are mounted in a variety of ways, depending on the circumstances. Sometimes, signals and other devices are mounted horizontally, that is, they are attached to a support at the sides rather than at the top or bottom. For example, a multi-light signal housing often is mounted with the lights arranged side-by-side instead of vertically. Horizontal mounting typically is accomplished by using a framework called a span wire assembly, which suspends the housing between a pair of span wires above and below the signal housing. Span wire assemblies typically are formed of a number of tubular rods and joints. While these conventional assemblies are serviceable, there is a need for a span wire assembly with a simpler design and fewer parts.

SUMMARY OF THE INVENTION

The present invention comprises a span wire support assembly for supporting an electrically powered traffic signal having two ends. The span wire support assembly comprises upper and lower horizontal members, each having first and second ends. Also included are first and second vertical members, and hardware for attaching the traffic signal to the vertical members.

Each vertical member is integrally formed and has an elongate body portion with first and second tubular ends. Each first and second tubular end is sized to receive a different one of the first and second ends of the upper and lower horizontal members. Still further, a wiring passage is formed through the elongate body portion of each vertical member.

In another aspect, the present invention is directed to a vertical support member. The vertical support member is designed for use in a span wire support assembly adapted for supporting a traffic control device with two ends. The span wire support assembly comprises upper and lower horizontal members, each having first and second ends, and hardware for attaching the traffic control device to the span wire support assembly.

The vertical support member comprises an integrally formed elongate body portion with first and second tubular ends. Each first and second tubular end is sized to receive a different one of the first and second ends of the upper and lower horizontal members. A wiring passage is formed through the elongate body portion.

DETAILED DESCRIPTION OF THE PREFERRED EMBODIMENTS

Figure 1:
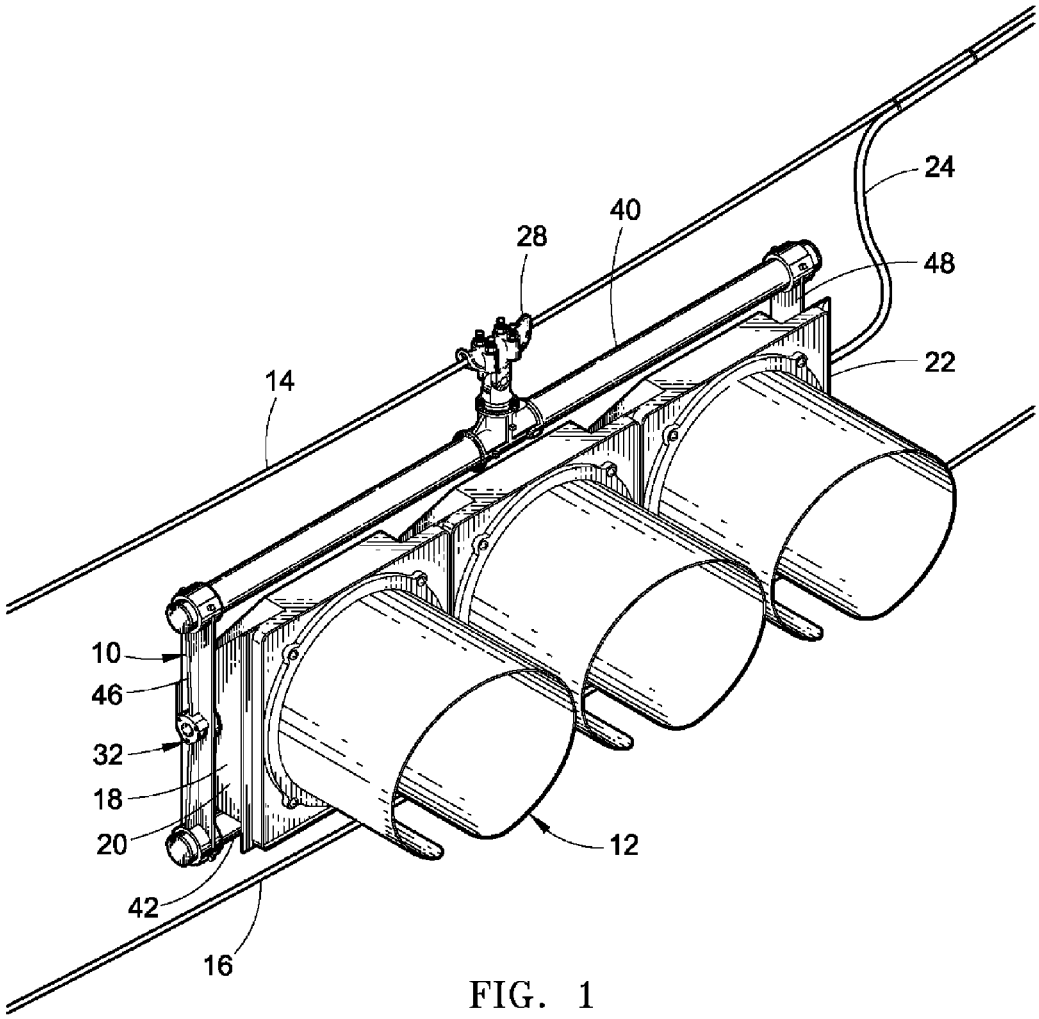
FIG. 1 is a perspective view of a span wire support assembly constructed in accordance with the present invention supporting a three-light traffic signal horizontally.

Turning now to the drawings in general and to FIG. 1 in particular, there is shown therein a span wire support assembly constructed in accordance with the present invention and designated generally by the reference numeral 10. In this figure, the span wire support assembly 10 is shown fully assembled and supporting a conventional three-light traffic signal 12 horizontally between upper and lower span wires 14 and 16.

The traffic signal 12 comprises an elongate housing 18 with two ends 20 and 22. The wiring 24 for supplying electrical power to the signal 12 is shown exiting the signal at the end 22 and is attached to the upper span wire 14 in any suitable manner.

Figure 2:
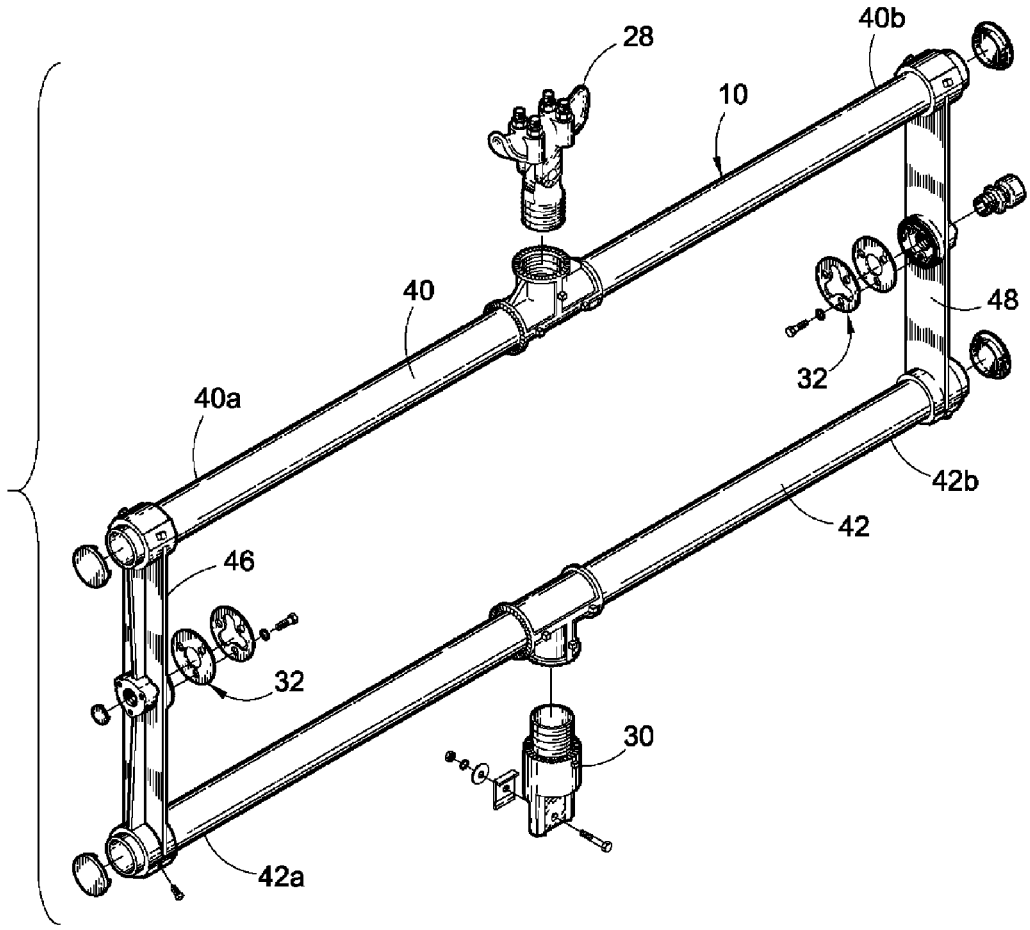
FIG. 2 is a partially exploded perspective view of the span wire assembly of FIG. 1 with the signal removed.

The signal 12 is suspended from the upper span wire 14, also referred to as a messenger cable or catenary cable, by the span wire clamp assembly 28. Referring now also to FIG. 2, which shows only the span wire support assembly 10 in exploded form, the signal 12 is secured to the lower span wire or tether cable 16 by the tether assembly 30 (shown only in FIG. 2). In some cases, it is advantageous to employ more than one attachment point to the messenger cable 14 or to the tether cable 16 or both.

Each end 20 and 22 of the traffic signal 12 is attached to the span wire support assembly 10 by hardware, designated only generally by the numeral 32. Although in this preferred embodiment, the hardware 32 attaches the signal by the ends 20 and 22 to the vertical members of the frame (described in more detail hereafter), the invention is not limited to this configuration. The hardware 32 could attach at different locations to the vertical members.

As shown in FIG. 1, the assembly 10 supports a three-light traffic signal 12 that is elongate, that is, it is substantially longer in one dimension than in another. It is to be understood, though, that the span wire support assembly 10 is adapted to support a wide range of traffic control devices, such as signs, alarms, detectors and sensors, which may or may not be electrical and may have different shapes. For example, the span wire assembly could be configured to support a square device.

Referring still to FIG. 2, in its preferred form, the span wire support assembly 10 preferably comprises upper and lower horizontal members 40 and 42. Each of the horizontal members 40 and 42 has first and second ends 40*a* and 40*b* and 42*a* and 42*b*, respectively. In the preferred practice of this invention, the upper and lower horizontal members 40 and 42 are elongate tubular members, preferably aluminum, that are identical and therefore interchangeable. However, the shape, material and identity of structure are not essential to the inventive assembly 10.

With continuing reference to FIG. 2, the span wire support assembly 10 further comprises first and second vertical members 46 and 48. As used herein, "horizontal" refers to the relative position of the component relative to the earth's surface in the assembled device, namely, that the axis of the longest dimension of the structure is arranged generally parallel to the plane of the earth in the assembled support 10. Likewise, "vertical" refers to the position of the structure in the assembly support 10 relative to the earth and denotes that the axis of the longest dimension of the structure is arranged generally normal to the plane of the earth.

Figure 3:
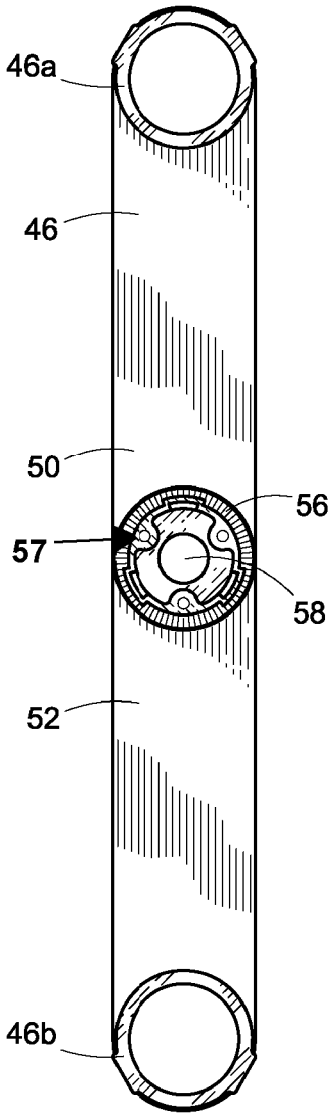
FIG. 3 is a front elevational view of one of the vertical members of the span wire assembly of FIG. 1.
Figure 4:
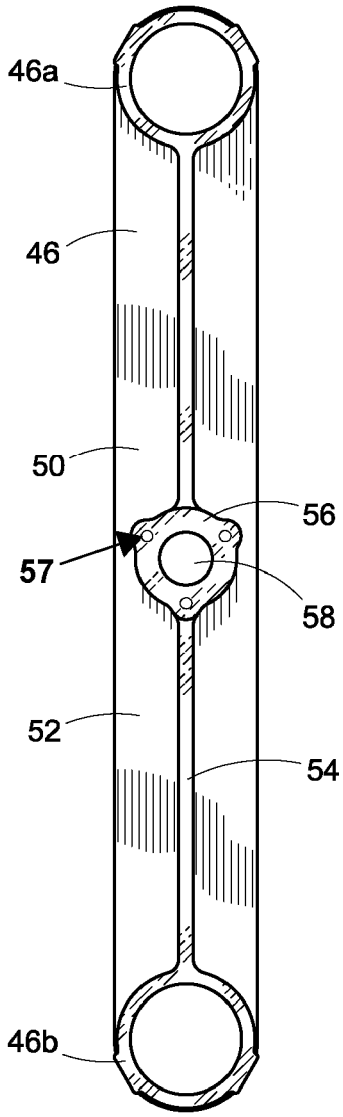
FIG. 4 is a back elevational view of one of the vertical members shown in FIG. 3.
Figure 5:
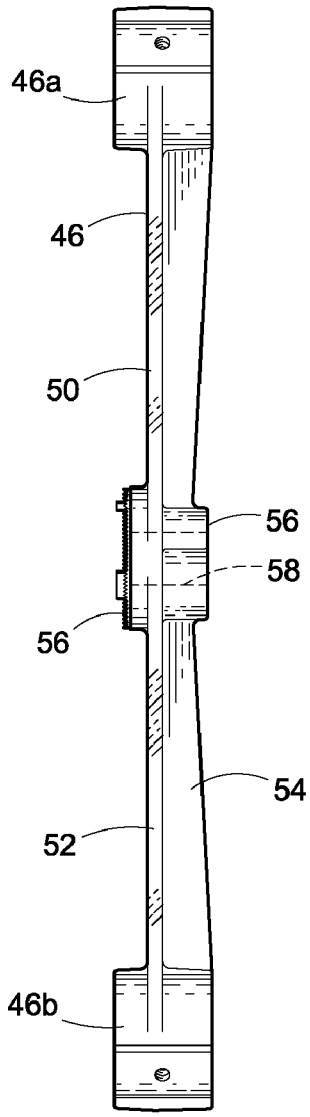
FIG. 5 is a side elevational view of the vertical member shown in FIG. 3.

Turning now to FIGS. 3-5, the preferred vertical member or "cast arm" configuration is shown in detail. In their preferred form, the vertical members 46 and 48 are both integrally formed, that is, cast in a single piece of metal or other suitable material, such as aluminum or plastic. In addition, the members 46 and 48 may be identically formed. In this way, each of the vertical members 46 and 48 are interchangeable. This simplifies manufacture as well as assembly of the support 10 by the user.

As the vertical members 46 and 48 are identically formed, only the member 46 is shown in FIGS. 3-5. The member 46 preferably comprises a solid elongate body portion 50. Although the shape and relative dimensions may vary, one suitable shape includes a planar back portion 52 and a longitudinal rib 54 extending the length thereof. This provides good strength and resistance to deformation.

The vertical member 46 further comprises first and second tubular ends 46*a* and 46*b*. Each of the ends is formed into a short tube sized to receive at least one of the ends 40*a*, 40*b*, 42*a*, 42*b* of the horizontal members 40 and 42. If, as is preferred, the horizontal members 40 and 42 are identical tubes, and all the ends are therefore also identical, then any of the ends 40*a*, 40*b*, 42*a*, 42*b* is receivable in either of the ends 46*a* and 46*b*.

Referring still to FIGS. 3-5, the body portion of the vertical member 46 is adapted to support one of the ends 20 and 22 of the traffic signal 12 or other traffic control device. To that end, the body portion 50 is provided with a two-sided attachment plate 56 to permit attachment of one of the ends of the signal 12 using the hardware 32 (FIG. 2). In the embodiment shown, the attachment plate is configured for a tri-bolt attachment system, but a tri-stud configuration or other attachment device easily could be substituted. For that purpose, the attachment plate 56 is provided with a plurality of bolt holes, such as the three bolt holes designated collectively at 57. In addition, bolts 59 may be included in the assembly 10. Preferably, the attachment plate 56 comprises a serrated face on the inner aspect to engage a corresponding serrated face on the signal housing 18, for example, as this prevents rotational shifting of the housing along the horizontal axis. The serrated face can be achieved by casting it as part of the arm or by using a lock ring.

As indicated previously, many of the traffic control devices that are supported in a span wire assembly are electrically powered and therefore have a power cord or electrical wiring, such as the wiring 24 (FIG. 1), extending from one or both ends. Accordingly, in the preferred embodiment of the vertical member 46, a wiring passage 58 is formed as an access opening through the attachment plate 56 of the elongate body 50. The diameter of the passage may vary, though one-half to one inch is suitable in most applications. This allows the wiring to extend from either or both ends of the span wire support assembly 10. In this embodiment, the bolt holes 57 are spaced circumferentially about the wiring passage 58.

Figure 6:
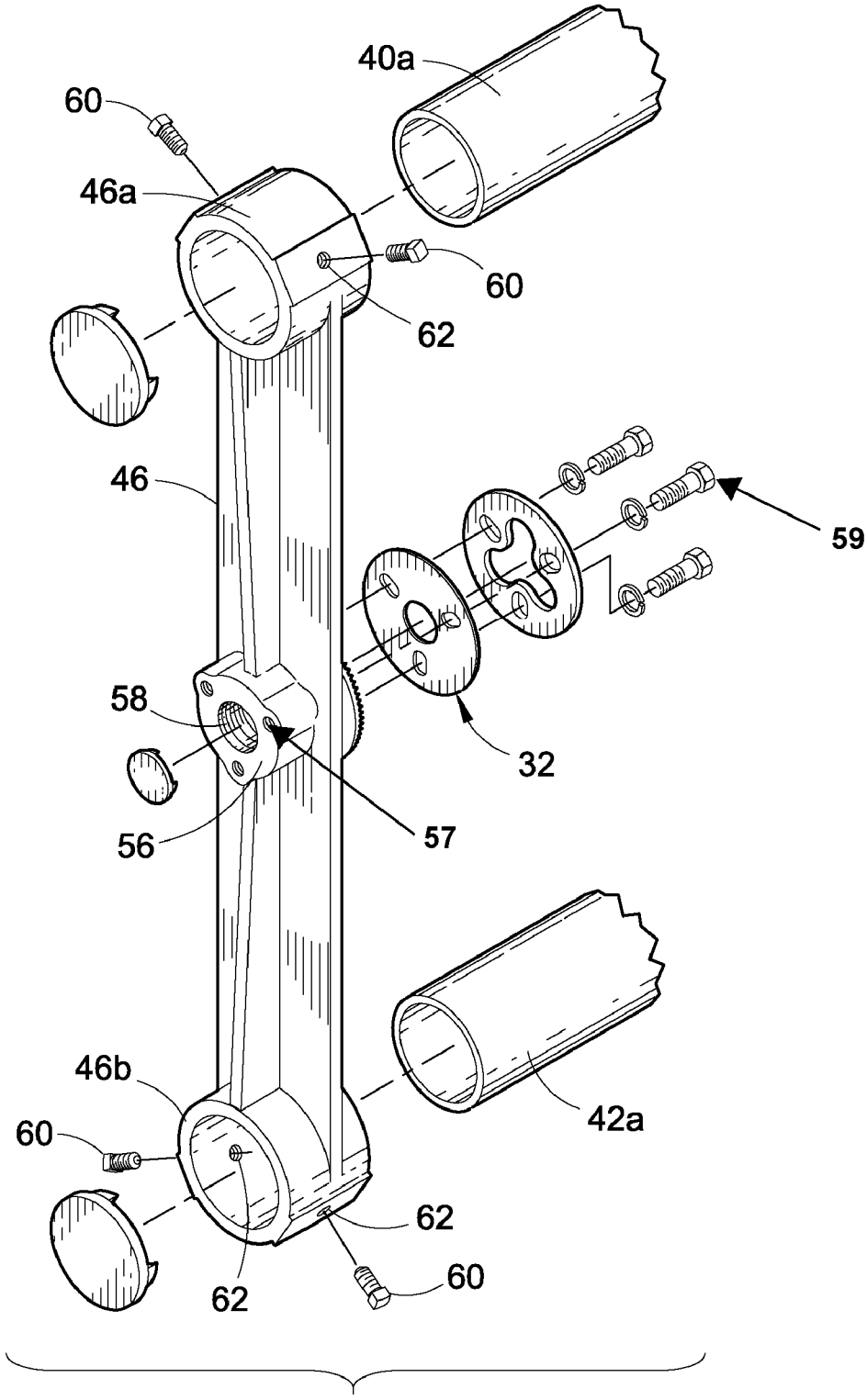
FIG. 6 is an enlarged, exploded view of one end of the span wire support assembly shown in FIG. 2.
Figure 7:
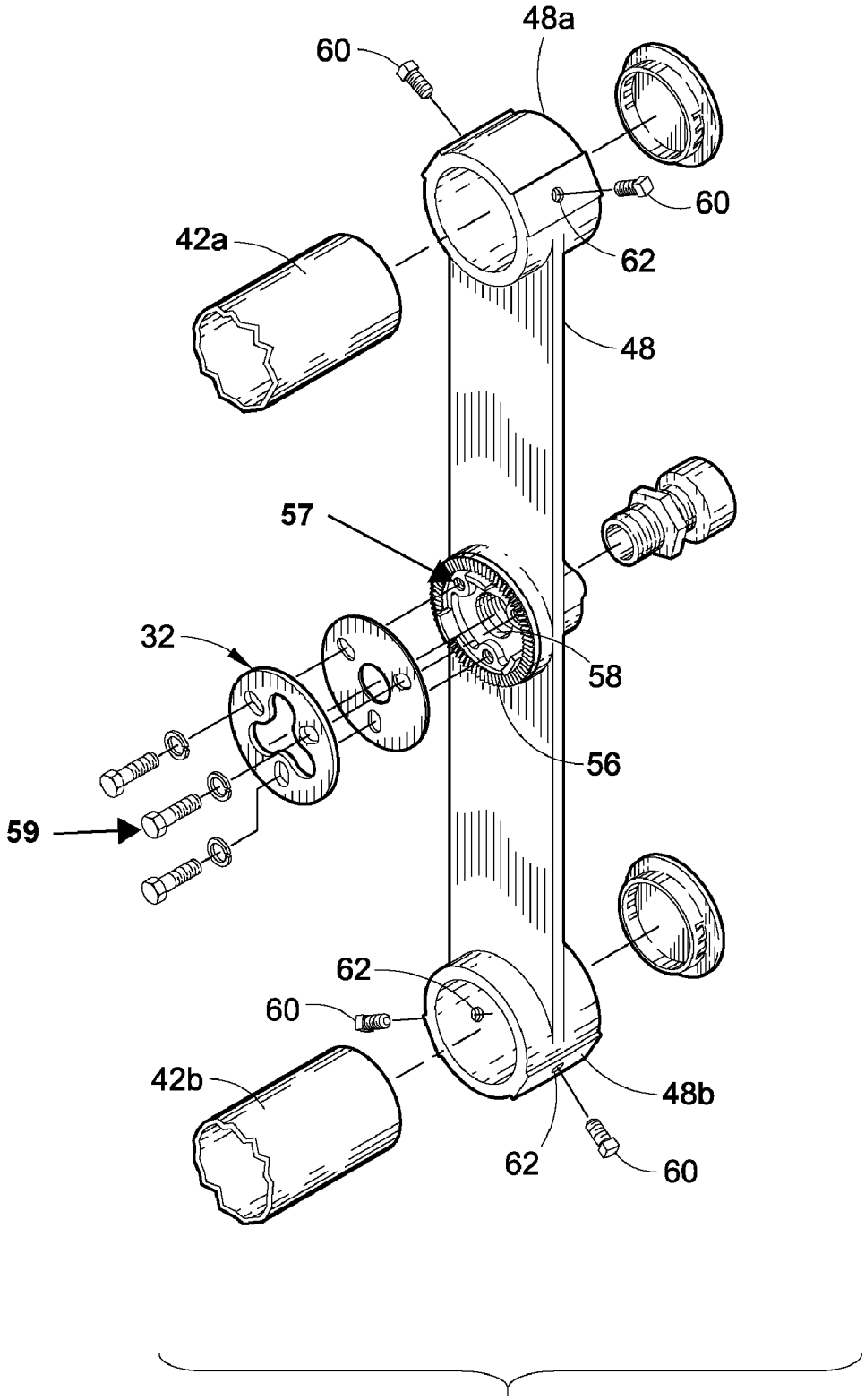
FIG. 7 is an enlarged, exploded view of the other end of the span wire support assembly shown in FIG. 2.

As shown in the enlarged exploded views of FIGS. 6 and 7, to which attention now is directed, each of the tubular ends 46*a* and *b* and 48*a* and *b* of the vertical members 46 (FIG. 6) and 48 (FIG. 7) preferably are adapted to be secured to the ends of the horizontal member 40 or 42 received therein. To that end, the ends 46*a* and *b* and 48*a* and *b* are provided with set screws 60 and set screw receiving openings 62. Thus configured, the ends 40*a* and 40*b* and 42*a* and 42*b* of the horizontal members 40 and 42 can be rotated or advanced axially in either direction until the desired position is achieved. Then the set screw 60 can be tightened to secure the horizontal member in the selected position. Alternately, other mechanisms such as compression clamps can be employed.

Figure 8:
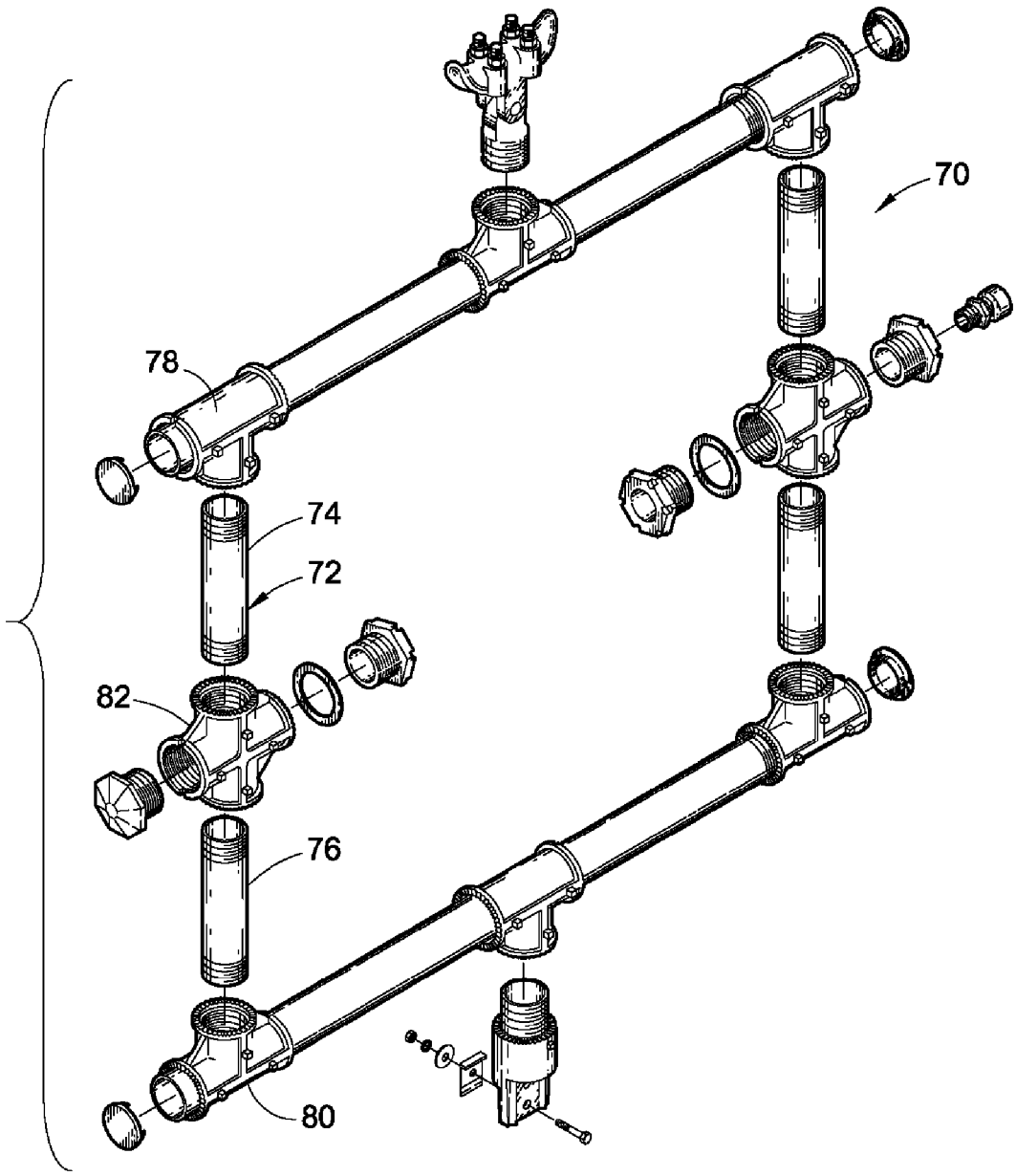
FIG. 8 (PRIOR ART)
FIG. 8 is an exploded view of a prior art span wire support assembly.

FIG. 8 illustrates a conventional span wire support assembly designated generally at 70. As seen, one of the vertical members 72 comprises two straight tubular portions 74 and 76. In addition, the distal ends of the tubular member 74 and 76 attach to t-shaped horizontal slips 78 and 80. The proximal ends of the tubular members 74 and 76 are connected by a cross-shaped member 82.

Now it will be appreciated that the integrally formed vertical members 46 and 48 of the inventive span wire assembly 10 provide a much simpler structure. The single vertical member of cast arm 46, as seen in FIG. 2, replaces five structures the conventional assembly 70. This simplifies manufacture, inventory, parts tracking and shipping, and invoicing for the manufacturer. In addition, the assembly of the span wire support 10, typically carried out by the customer in the field, is also streamlined, as so many parts and connections are omitted.

Changes can be made in the combination and arrangement of the various parts and elements described herein without departing from the spirit and scope of the invention as defined in the following claims.

What is claimed is:

1. A span wire support assembly for supporting a traffic control device having two ends, the span wire support assembly comprising:

upper and lower horizontal members, each having first and second ends;

first and second vertical members; and hardware for attaching the traffic control device to the vertical members;

wherein each vertical member comprises a solid, integrally formed elongate body portion with first and second tubular ends, each first and second tubular end being sized to receive a different one of the first and second ends of the upper and lower horizontal members, wherein the body portion of each vertical member is adapted to support one of the ends of the traffic control device, and wherein a wiring passage is formed through the elongate body portion of each vertical member;

whereby, when assembled, the support assembly is adapted to support the traffic control device on the vertical members between the upper and lower horizontal members.

2. The span wire support assembly of claim 1 wherein the first and second ends of the upper and lower horizontal members are similarly formed, and wherein the first and second vertical members are identically formed, so that the first and second vertical members are interchangeable.

3. The span wire support assembly of claim 1 comprising a span wire clamp assembly.

4. The span wire support assembly of claim 1 comprising a tether assembly.

5. The span wire support assembly of claim 1 wherein each of the tubular ends of the first and second vertical members is adapted to be secured to the end of the horizontal member received therein.

6. The span wire support assembly of claim 5 wherein each of the tubular ends of the first and second vertical members is provided with a set screw and set screw receiving opening.

7. A vertical support member for use in a span wire support assembly, wherein the span wire support assembly is adapted for supporting a traffic control device, wherein the span wire support assembly comprises upper and lower horizontal members, each having first and second ends and hardware for attaching the traffic control device to the span wire support assembly, the vertical support member comprising:

a solid, integrally formed elongate body portion with first and second tubular ends, each first and second tubular end being sized to receive a different one of the first and second ends of the upper and lower horizontal members, wherein the body portion is adapted to support one of the two ends of the traffic control device and has a wiring passage formed therethrough.

8. The vertical support member of claim 7 wherein each of the tubular ends is adapted to be secured to the end of a horizontal member received therein.

9. The vertical support member of claim 8 wherein each of the tubular ends is provided with a set screw and set screw receiving opening.

* * * * *